US005443714A

United States Patent [19]

Schmidt et al.

[11] Patent Number: 5,443,714

[45] Date of Patent: Aug. 22, 1995

[54] PROCESS AND ELECTROLYTE FOR DEPOSITING LEAD AND LEAD-CONTAINING LAYERS

[75] Inventors: Karl-Jürgen Schmidt, Solingen; Eberhard Knaak, Langenfeld, both of Germany

[73] Assignee: Blasberg Oberflachentechnik, GmbH, Germany

[21] Appl. No.: 848,952

[22] PCT Filed: Oct. 5, 1990

[86] PCT No.: PCT/EP90/01670

§ 371 Date: May 29, 1992

§ 102(e) Date: May 29, 1992

[87] PCT Pub. No.: WO91/05890

PCT Pub. Date: Mar. 2, 1991

[30] Foreign Application Priority Data

Oct. 19, 1989 [DE] Germany ..... 39 34 866.0

[51] Int. Cl.[6] ..... C25D 3/32; C25D 3/36; C25D 3/38

[52] U.S. Cl. ..... 205/241; 205/253; 205/299

[58] Field of Search ..... 205/299, 239, 241, 252, 205/253

[56] References Cited

U.S. PATENT DOCUMENTS

| | | | |
|---|---|---|---|
| 3,661,730 | 5/1972 | Nishihara | 205/253 |
| 3,850,765 | 11/1974 | Karustis, Jr. et al. | 205/253 |
| 4,033,835 | 7/1977 | Lerner et al. | 205/253 |
| 4,053,372 | 10/1977 | Davis | 205/253 |
| 4,139,425 | 2/1979 | Eckles et al. | 205/253 |
| 4,384,930 | 5/1983 | Eckles | 205/253 |
| 4,459,185 | 7/1984 | Dbata et al. | 205/299 |
| 4,565,609 | 1/1986 | Nobel et al. | 205/299 |
| 4,565,610 | 1/1986 | Nobel et al. | 205/299 |
| 4,599,149 | 7/1986 | Nobel et al. | 205/299 |
| 4,617,097 | 10/1986 | Nobel et al. | 205/299 |
| 4,701,244 | 10/1987 | Nobel et al. | 205/299 |
| 4,717,460 | 1/1988 | Nobel et al. | 205/299 |

*Primary Examiner*—Donald R. Valentine

*Attorney, Agent, or Firm*—Banner & Allegretti, Ltd.

[57] ABSTRACT

A process for acidic electrolytical deposition of lead layers and predominantly lead-containing layers onto surfaces using an electrolyte containing lead salts and acids, in particular alkanesulfonic acid, borofluoric acid or silicofluoric acid, with non-ionic surfactants and cationic or amphoteric surfactants being added to the electrolyte. The process can be operated at current densities of from 0.5 to 20 A/dm$^2$ and at a pH value below 1.

20 Claims, No Drawings

PROCESS AND ELECTROLYTE FOR DEPOSITING LEAD AND LEAD-CONTAINING LAYERS

The present invention relates to a process for acidic electrolytical deposition of lead layers and predominantly lead-containing layers onto surfaces using an electrolyte containing lead salts and acids, in particular alkanesulfonic acid, borofluoric acid or silicofluoric acid. Furthermore, the present invention relates to an electrolyte for performing the process and the use of surfactants in acidic lead electrolytes.

Processes for acidic electrolytical deposition of lead layers and predominantly lead-containing layers are known in prior art. In these processes, only lead fluorosilicate, lead fluoroborate and lead perchlorate electrolyte have been gaining special significance. To these lead electrolytes are added organic materials, e.g., gelatin, glue, peptones, phenolsulfonic acid, and waste sulfite liquor to obtain fine-grained, smooth precipitates.

Among these known electrolytes, the lead perchlorate electrolyte, in particular, is said to have special merits:

1. good solubility.,
2. high electrical conductivity,
3. good chemical stability,
4. a 100% anodic and cathodic current efficiency,
5. smooth, dense coatings, and
6. no polarization phenomenons.

In spite of these obvious advantages, the lead perchlorate electrolyte could not gain acceptance in practice. Drawbacks of this electrolyte result, in particular, from the dangerousness of perchlorate.

From U.S. Pat. No. 2,525,942, acidic lead electrolytes on the basis of the alkanesulfonate are known. The drawback of the electrolytes mentioned therein is that lead deposited therefrom forms an amorphous, non-dense, porous layer of lead. Furthermore, this electrolyte permits deposition only in a very narrow range of current density.

U.S. Pat. No. 4,701,244 discloses an electrolytical bath for the deposition of tin and lead in the presence of excess (lower alkylsulfonic acid or acid salt containing the following admixtures: additives such as benzalacetone, benzaldehydes and aromatic pyridines, surface-active substances such as betaines, alkylene oxide, polymeres, imidazolinium compounds, and quaternary ammonium salts, and formaldehyde. No disclosure is made whatsoever concerning the combination of non-ionic surfactants and cationic or amphoteric surfactants in an electrolyte for the deposition of lead layers and predominantly lead-containing layers.

It is object of the present invention to provide a process for acidic electrolytical deposition of lead layers and predominantly lead-containing layers onto surfaces, the merits of which resembling those of electrolysis using lead perchlorate without having the extraordinary dangerousness of same process.

Now, this problem is solved in surprisingly simple fashion by a process wherein the electrolyte, in addition to lead salts and acids, particularly alkanesulfonic acid, borofluoric acid or silicofluoric acid, contains non-ionic surfactants and/or cationic or amphoteric surfactants.

Using the process according to the invention, it is now possible to obtain smooth, dense and finely crystalline lead deposits even on basis materials having gross deformations. Moreover, in the process according to the invention, polarization phenomenons of previously used electrolytes are reduced both in the anode and cathode reactions. At the same time, better anode solubility is achieved. It is of particular advantage that applicable cathodic current densities are higher. Thus, it is possible to operate using substantially lower electrolyte lead content. As a consequence, the rinsing water lead contamination is lower as well. Thus, on the whole, waste management of both lead-containing electrolyte and rinsing water is substantially simplified.

Hence, subject matter of the present invention is a process for acidic electrolytical deposition of lead layers and predominantly lead-containing layers onto surfaces using an electrolyte containing lead salts and acids, in particular alkanesulfonic acid, borofluoric acid or silicofluoric acid, characterized in that non-ionic surfactants and cationic or amphoteric surfactants are added to the electrolyte. Preferably, the process according to the invention is operated at current densities of from 0.5 to 20 A/dm$^2$ and at a pH value below 1. In another preferred embodiment of the process according to the invention, operating is done at a temperature of from 20° to 80° C., preferably from 30° to 50° C. In the process according to the invention, the free acid content is adjusted to from 50 to 150 g/l, preferably. In the process of the invention, operating is done at lead contents of from 10 to 200 g/l, preferably. Particularly preferred is a lead content of from 10 to 60 g/l. The overall concentration of non-ionic surfactants and cationic and amphoteric surfactants should be from 1 to 15 g/l. Preferably, the concentration of cationic or amphoteric surfactants is from 0.1 to 3 g/l.

Another object of the present invention is an electrolyte for acidic electrolytical deposition of lead layers and pre-dominantly lead-containing layers onto surfaces, characterized in that there are contained a) a soluble lead salt, optionally with smaller amounts of additional soluble metal salts, b) free acids such as alkanesulfonic acids, borofluoric acid or silicofluoric acid, c) non-ionic surfactants and cationic or amphoteric surfactants.

Preferably, the soluble lead salt and the optionally additional metal salts are fluoroborates, fluorosilicates and/or alkanesulfonates. Especially preferred as an additional soluble metal salt is a copper and/or tin salt. Preferably, the non-ionic surfactant is an alkanol, alkylphenol, alkylamino-, arylphenol polyglycol ether, or a block polymerizate of ethylene oxide or propylene oxide. Where the non-ionic surfactant is a polyglycol ether, it preferably has from 7 to 30 moles of ethylene oxide per mole. Preferably, the polyglycol ether has a $C_5$–$C_{20}$ alkanol or alkyl residue. In another electrolyte embodiment of the invention, the amphoteric surfactant is cation-active at a pH value below 1. In another preferred embodiment, a cation surfactant, preferably a quaternary ammonium compound, is present in addition to the non-ionic surfactant.

Another object of the present invention is the use of non-ionic surfactants and cationic or amphoteric surfactants in acidic lead electrolytes for electrolytical deposition of lead layers and predominantly lead-containing layers onto surfaces.

The following reference experiment as well as the examples demonstrate both the process itself and its merits.

REFERENCE EXPERIMENT The following electrolytes were examined:

Electrolyte I (prior art).

110.0 g/l of lead as lead fluoroborate
50.0 g/l of free borofluoric acid
0.2 g/l of glue.

Electrolyte II (prior art)

20.0 g/l of lead as lead alkanesulfonate
5.0 g/l of free alkanesulfonic acid
0.2 g/l of glue.

Electrolyte III (prior art)

15.0 g/l of lead as lead fluoroborate
50.0 g/l of free borofluoric acid
3.0 g/l of nonylphenol polyglycol ether with 10 moles of ethylene oxide/mole Electrolyte IV (according to the invention)

15.0 g/l of lead as lead fluoroborate
50.0 g/l of free borofluoric acid
3.0 g/l of nonylphenol polyglycol ether with 10 moles of ethylene oxide/mole
0.5 g/l dodecyldimethylbenzylammonium chloride Electrolyte V (according to the invention)

20.0 g/l of lead as lead fluorosilicate
50.0 g/l of free silicofluoric acid
5.0 g/l of coconut fatty alcohol polyglycol ether with 13 moles of ethylene oxide/mole
1.0 g/l of (ditallow fatty alkyl)dimethylammonium chloride Electrolyte VI (according to the invention)

60.0 g/l of lead as lead alkanesulfonate
100.0 g/l of free alkanesulfonic acid
7.0 g/l of synthetic alcohol polyglycol ether with 15 moles of ethylene oxide/mole
1.0 g/l of doecyldimethylbenzylammonium chloride Electrolyte VII (according to the invention)

20.0 g/l of lead as lead alkanesulfonate
70.0 g/l of free alkanesulfonic acid
5.0 g/l of β-naphthol polyglycol ether with 9 moles of ethylene oxide/mole
1.0 g/l of TRITON QS 15 (amphoteric surfactant by company Röhm & Haas)

The above electrolytes were subjected to electrolysis in a Hull cell having brass sheets. Electrolysis was done at a cell current of 1.5 A for 10 minutes at room temperature with gentle stirring using a magnetic stirrer.

Using electrolytes according to prior art, only dark and grey lead precipitates could be obtained. In addition, with electrolyte I the sheet was amorphously burnt at high current density range. With electrolyte II, only the first 2 cm were covered with a dark amorphous layer. From about 5 cm on, deposition did no longer occur. At high current density range, electrolyte III showed burning in the form of a dark amorphous deposit.

Using electrolytes IV to VI of the invention, a uniformly bright and finely crystalline precipitate having very broad covering on the backside was found.

EXAMPLE 1

By co-precipitation of, for example, tin and/or copper, the process of the invention is conveniently suited for providing solderable layers on surfaces (lead with portions of from 5 to 15% of tin). For this purpose, an electrolyte having the following composition was used for the electrolytical coating of a brass sheet using the same conditions as in the reference experiment:

20.0 g/l of lead as lead fluoroborate
2.0 g/l of tin as tin fluoroborate
50.0 g/l of free borofluoric acid
2.0 g/l of β-naphthol polyglycol ether with 12 moles of ethylene oxide/mole
0.5 g/l of dodecyldimethylbenzylammonium chloride The finely crystalline and bright precipitate was found to be excellently solderable. Analysis of the removed and analyzed metal coating revealed a content of 88% by weight of lead and 12% by weight of tin.

EXAMPLE 2

Also of special interest are lead-containing inlet layers on slide bearings (lead with 10% of tin and 3% of copper). Here, an electrolyte of following composition at a current density of about 10 A/dm$^2$ was used for coating bearing shells having an inlet layer of about 30 μm thickness.

50.0 g/l of lead as lead alkanesulfonate
10.0 g/l of tin as tin alkanesulfonate
4.0 g/l of copper as copper alkanesulfonate
70.0 g/l of free alkansulfonic acid
8.0 g/l of nonylphenol polyglycol ether with 14 moles of ethylene oxide/mole
1.5 g/l of dodecyldimethylbenzylammonium chloride Electrolysis furnished a finely crystalline and bright precipitate. Analysis of the precipitate revealed 85% of lead, 11% of tin and 4% of copper.

We claim:

1. A process for electrolytical deposition of lead layers and predominantly lead-containing layers from acidic solutions onto surfaces using an electrolyte consisting essentially of an alkanesulfonate salt of lead, an acid selected from the group consisting of alkanesulfonic acid, borofluoric acid, and silicofluoric acid, and an agent selected from the group consisting of a cationic surfactant, an amphoteric surfactant, a mixture of a nonionic surfactant and cationic surfactant, and a mixture of a nonionic and amphoteric surfactant, and wherein the electrolyte is maintained at a pH less than 1.

2. The process of claim 1 wherein the deposition is carried out at current densities of from 0.5 to 20 A/dm$^2$.

3. The process of claim 1 wherein deposition is carried out at a temperature of from 20° to 80° C.

4. The process of claim 1 wherein deposition is carried out at a temperature of from 30°–50° C.

5. The process according to claim 1 wherein the electrolyte has a free-acid content of from 50–150 g/l.

6. The process according to claim 1 wherein the electrolyte has a lead content of from 10 to 200 g/l.

7. The process of claim 1 wherein the electrolyte has a lead content of from 10 to 60 g/l.

8. The process of claim 1 wherein the agent is a mixture of a nonionic surfactant and a cationic surfactant or a mixture of a nonionic surfactant and an amphoteric surfactant at a concentration of 1 to 15 g/l.

9. The process of claim 1 wherein the agent is a cationic surfactant or an amphoteric surfactant at a concentration of 0.1 to 3 g/l.

10. A process for electrolytical deposition according to claim 1 wherein the acid is an alkanesulfonic acid.

11. An electrolyte for acidic electrolytical deposition of lead layers and predominantly lead-containing layers onto surfaces consisting essentially of:

a) a soluble alkanesulfonate lead salt;

b) a free acid selected from the group consisting of alkanesulfonic acid, borofluoric acid, and silicofluoric acid; and c) an agent selected from the group consisting of a nonionic surfactant, a cationic surfactant, an amphoteric surfactant, a mixture of a nonionic surfactant and a cationic surfactant, and a mixture of a nonionic surfactant and an amphoteric surfactant; maintained at a pH less than 1.

12. The electrolyte of claim 11 further comprising a soluble metal salt.

13. The electrolyte of claim 11 further consisting of a soluble copper salt, a soluble tin salt, or a combination thereof, the weight percent of the copper salt, tin salt, or combination thereof being substantially less than the weight percent of the lead salt.

14. The electrolyte of claim 11 wherein the agent comprises a nonionic surfactant selected from the group consisting of an alkanol polyglycol ether, an alkylphenol polyglycol ether, an alkylamino polyglycol ether, an arylphenol polyglycol ether, a blocked polymer of ethylene oxide, and a blocked polymer of propylene oxide.

15. The electrolyte of claim 11 wherein the agent comprises a nonionic surfactant selected from the group consisting of an alkanol polyglycol ether, alkylphenol polyglycol ether, alkylamino polyglycol ether, and arylphenol polyglycol ether having from 7 to 30 moles of ethylene oxide per mole of the polyglycol ether.

16. The electrolyte of claim 11 wherein the agent comprises a nonionic surfactant selected from the group consisting of a $C_5$–$C_{20}$ alkanol polyglycol ether, a $C_5$–$C_{20}$ alkylphenol polyglycol ether, and a $C_5$–$C_{20}$ alkylamino polyglycol ether.

17. The electrolyte of claim 11 wherein the agent comprises an amphoteric surfactant that is cation-active at a pH less than 1.

18. The electrolyte according to claim 11 wherein the agent is a mixture of a nonionic surfactant and a cationic surfactant.

19. The electrolyte of claim 11 wherein the agent is a mixture of a cationic surfactant and a nonionic surfactant, wherein the cationic surfactant is a quaternary ammonium compound.

20. An electrolyte according to claim 11 wherein the free acid is an alkanesulfonic acid.

* * * * *